US009609447B2

(12) United States Patent
Miske et al.

(10) Patent No.: US 9,609,447 B2
(45) Date of Patent: Mar. 28, 2017

(54) AUDIO JACK INSERTION/REMOVAL FAULT DETECTION

(71) Applicant: Fairchild Semiconductor Corporation, San Jose, CA (US)

(72) Inventors: Myron J. Miske, Newfields, NH (US); Christian Klein, Portland, ME (US); John R. Turner, Portland, ME (US); Peter Chadbourne, Portland, ME (US)

(73) Assignee: FAIRCHILD SEMICONDUCTOR CORPORATION, San Jose, CA (US)

( * ) Notice: Subject to any disclaimer, the term of this patent is extended or adjusted under 35 U.S.C. 154(b) by 0 days.

(21) Appl. No.: 14/707,482

(22) Filed: May 8, 2015

(65) Prior Publication Data

US 2015/0326970 A1 Nov. 12, 2015

Related U.S. Application Data

(60) Provisional application No. 61/991,187, filed on May 9, 2014.

(51) Int. Cl.

| | |
|---|---|
| ***H04R 29/00*** | (2006.01) |
| ***H04R 3/00*** | (2006.01) |
| ***H04R 1/10*** | (2006.01) |

(52) U.S. Cl.

CPC ..... *H04R 29/00* (2013.01); *H04R 1/1041* (2013.01); *H04R 3/00* (2013.01); *H04R 2420/05* (2013.01)

(58) Field of Classification Search

CPC .. H04R 2420/05; H04R 2420/01; H04R 5/04; H04R 29/004; H04R 3/00; H04R 1/1033; H04R 2420/09; H04R 29/00; H04R 5/033; H04R 1/1041; H04R 2420/03; H04R 2420/07; H04R 2460/01; H04R 2460/03; H04R 2499/13; H04R 29/001; H04R 2201/107; H04R 1/02; H04R 1/1083; H04R 2410/00

USPC ..... 381/74, 120, 123, 384, 58, 309, 394, 59, 381/94.6, 111, 28, 379, 55, 61, 63, 71.6, 381/77, 79, 94.1, 94.5, 17, 369, 1, 103, (Continued)

(56) References Cited

U.S. PATENT DOCUMENTS

| | | | |
|---|---|---|---|
| 6,460,094 | B1 | 10/2002 | Hanson et al. |
| 6,671,814 | B1 | 12/2003 | Kubo et al. |
| 7,352,289 | B1 | 4/2008 | Harris |

(Continued)

FOREIGN PATENT DOCUMENTS

| | | | |
|---|---|---|---|
| CN | 105101009 | A | 11/2015 |
| KR | 1020150128617 | A | 11/2015 |

OTHER PUBLICATIONS

U.S. Appl. No. 14/174,394, filed Feb. 6, 2014, Audio Jack Detector and Audio Jack Detecting Method.

(Continued)

*Primary Examiner* — Akelaw Teshale

(74) *Attorney, Agent, or Firm* — Schwegman Lundberg & Woessner, P.A.

(57) ABSTRACT

This document discusses, among other things, circuits and methods for providing an indication of an impedance between a detecting pin and a first signal pin of an audio socket using first and second comparators to, among other things, determine if moisture is present in the audio socket. If moisture is present in the audio socket, communication between an audio processing unit and the audio socket can be disabled.

20 Claims, 12 Drawing Sheets

(58) Field of Classification Search
USPC .. 381/107, 122, 22, 71.1, 91, 113, 334, 357, 381/370, 66
See application file for complete search history.

(56) References Cited

U.S. PATENT DOCUMENTS

| | | | | |
|---|---|---|---|---|
| 8,193,834 | B2 | 6/2012 | Maher et al. | |
| 2007/0245058 | A1 | 10/2007 | Wurzburg et al. | |
| 2012/0263316 | A1* | 10/2012 | Poulsen | H04R 3/00 381/94.6 |
| 2013/0020882 | A1* | 1/2013 | Prentice | H04R 29/004 307/116 |
| 2014/0031657 | A1 | 1/2014 | Mckee et al. | |
| 2014/0038460 | A1* | 2/2014 | Lee | H04R 29/004 439/620.01 |
| 2014/0225632 | A1* | 8/2014 | Oh | H02B 1/00 324/713 |
| 2014/0233741 | A1* | 8/2014 | Gustavsson | H04R 5/04 381/58 |

OTHER PUBLICATIONS

"U.S. Appl. No. 14/174,394, Non Final Office Action mailed Apr. 18, 2016", 23 pgs.
"U.S. Appl. No. 14/174,394, Preliminary Amendment filed Mar. 21, 2014", 9 pgs.
"U.S. Appl. No. 14/174,394, Response filed Jul. 18, 2016 to Non Final Office Action mailed Apr. 18, 2016", 12 pgs.
"U.S. Appl. No. 14/174,394, Supplemental Preliminary Amendment filed Jun. 19, 2014", 9 pgs.

* cited by examiner

AUDIO JACK INSERTION/REMOVAL FAULT DETECTION

CLAIM OF PRIORITY

This application claims the benefit of priority under 35 U.S.C. §119(e) of Myron J. Miske et al. U.S. Provisional Patent Application Ser. No. 61/991,187, titled "AUDIO JACK INSERTION/REMOVAL FAULT DETECTION," filed on May 9, 2014, which is incorporated by reference herein in its entirety.

BACKGROUND

Electronic devices are commonly configured to pair to various accessory devices using one or more accessory ports. For example, the electronic device can include an audio socket configured to receive the audio jack of an accessory device.

In certain examples, it can be advantageous for the electronic device to operate differently when an audio jack is coupled to the electronic device than when an audio jack is not coupled to the electronic device. For example, when the audio jack is coupled to the electronic device, an audio signal can be re-routed from the speaker of the electronic device to an accessory device (e.g., an earphone, an external speaker, etc.) coupled to the electronic device through the audio jack. For this and other reasons, certain electronic devices include detection circuits configured to detect when an audio jack is coupled to an audio socket.

OVERVIEW

This document discusses, among other things, circuits and methods for providing an indication of an impedance between a detecting pin and a first signal pin of an audio socket using first and second comparators to, among other things, determine if moisture is present in the audio socket. If moisture is present in the audio socket, communication between an audio processing unit and the audio socket can be disabled.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
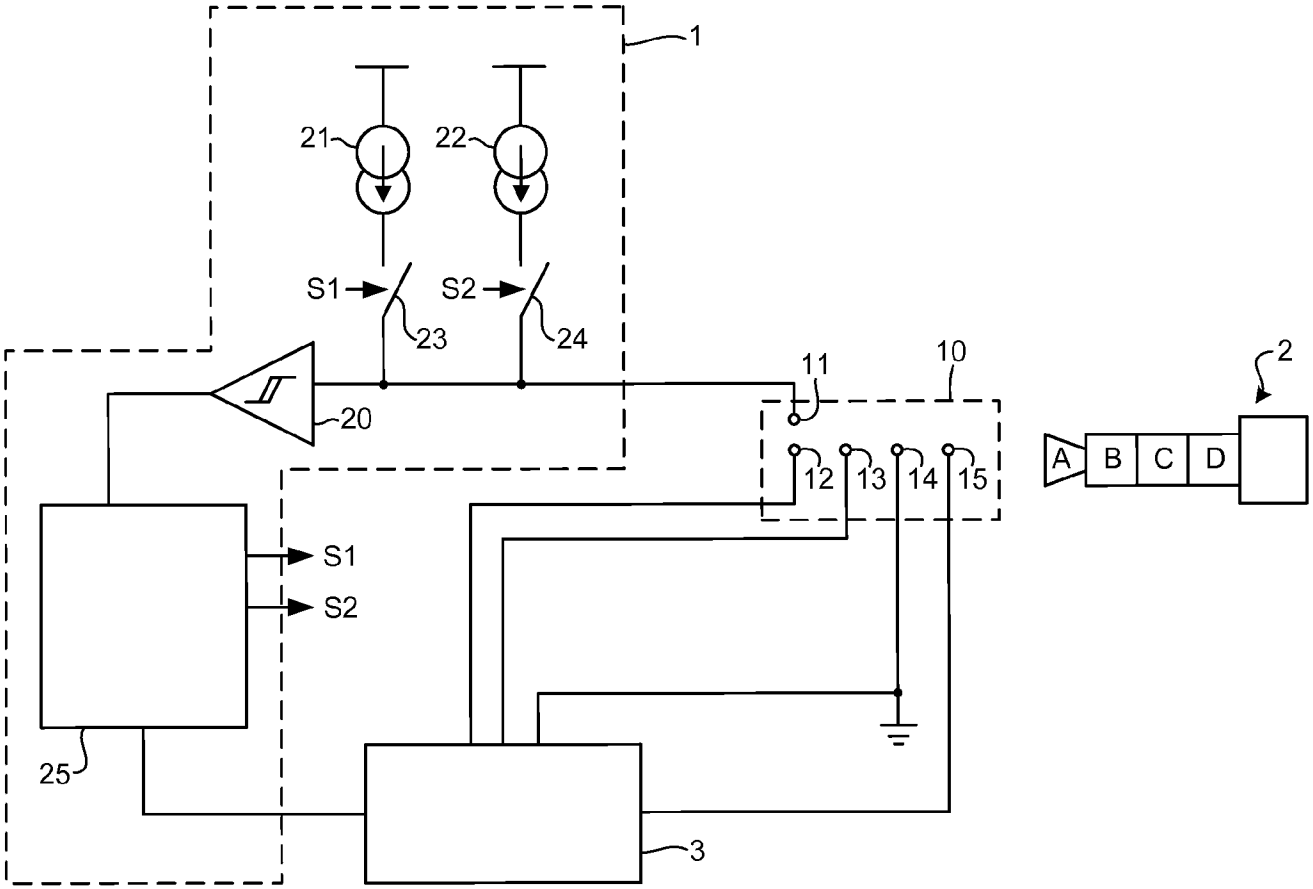
FIG. 1 PRIOR ART
FIGS. 1-12 illustrate generally example audio jack detection systems and circuits.
Figure 2:
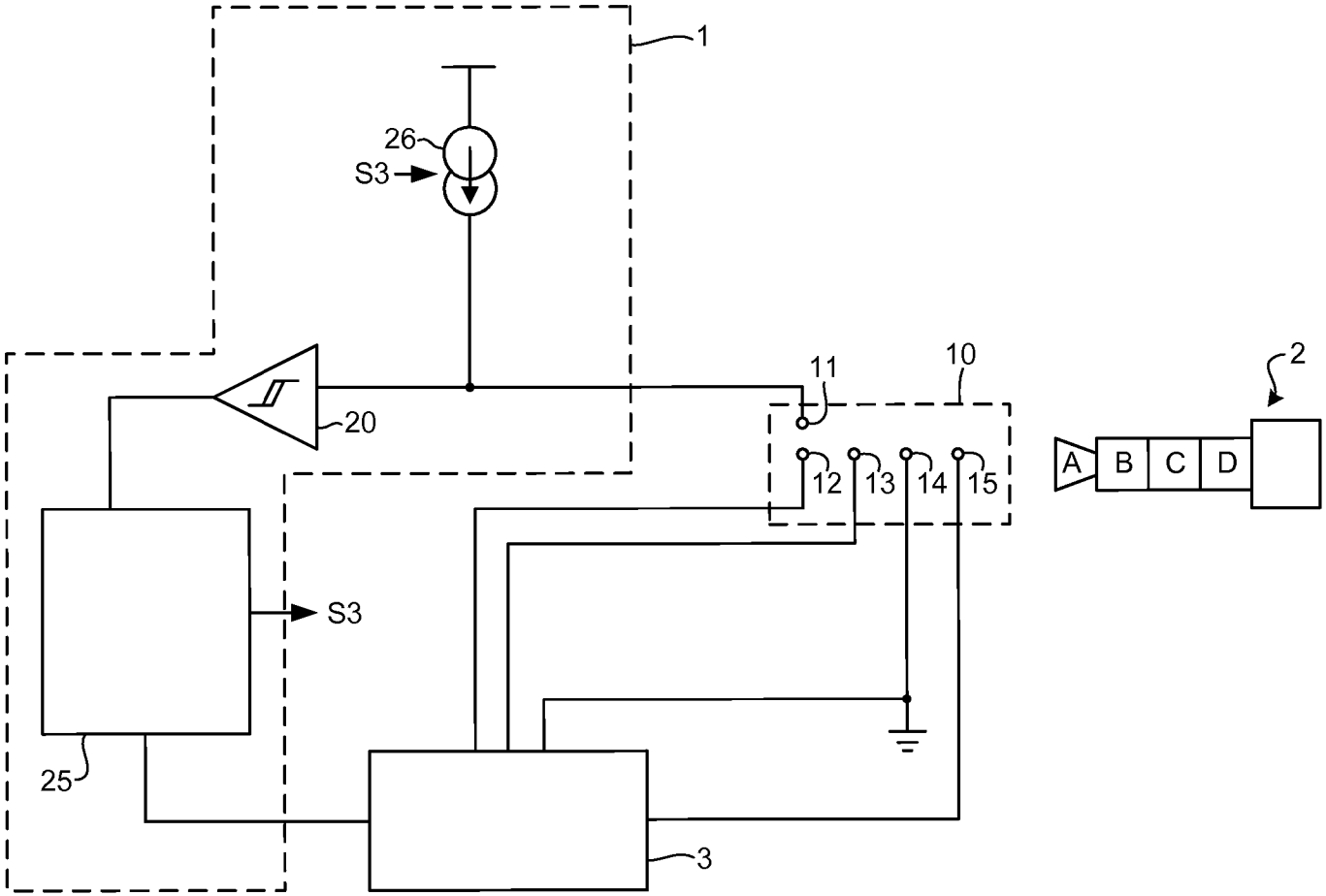
FIG. 2 PRIOR ART

FIGS. 1 and 2 illustrate generally audio jack detection systems including an audio jack detection circuit 1, an audio socket 10, an audio jack 2, and an audio processing unit 3, such as disclosed in the commonly assigned Oh et al. US Patent Application No. 2014/0225632, titled "Audio Jack Detector and Audio Jack Detecting Method," filed on Feb. 6, 2014, which is hereby incorporated by reference in its entirety.

The audio socket 10 includes a detecting pin 11, a first signal pin 12, a second signal pin 13, a ground pin 14, and a microphone (MIC) pin 15. In FIG. 1, the audio jack detector 1 and the audio socket 10 are separated from each other. In other examples, they, or components thereof, may be combined.

The audio processing unit 3 can receive an enable signal (EN) from the audio jack detector 1 and can determine whether the audio jack 2 is combined with the audio socket 10 in accordance with an enable signal. If the audio processing unit 3 determines that the audio jack 2 is combined with the audio socket 10, the audio processing unit 3 may supply a left audio signal (LSP) and a right audio signal (RSP) to the first signal pin 12 and the second signal pin 13, respectively.

Further, in certain examples, if the audio processing unit 3 determines that the audio jack 2 is combined with the audio socket 10, the audio processing unit 3 may supply a bias current to the MIC pin 15 and process an input of the MIC pin 15 when the input MIC is sensed by the MIC pin 15 to generate an audio signal.

The audio jack 2 includes a left audio terminal (A), a right audio terminal (B), a ground terminal (C), and a MIC terminal (D). When the audio jack 2 is combined with the audio socket 10, the left audio terminal is connected to the detecting pin 11 and the first signal pin 12, the right audio terminal is connected to the second signal pin 13, the ground terminal is connected to the ground pin 14, and the MIC terminal is connected to the MIC pin 15. In other examples, the detecting pin 11 can be connected to one or more other terminal of the audio jack 2.

The audio jack detector 1 includes a buffer 20, a first current source 21, a second current source 22, a first switch 23, a second switch 24, and a controller 25. The first current source 21 can generate a first detecting current (I1). The second current source 22 can generate a second detecting current (I2). The first switch 23 is connected between the first current source 21 and the detecting pin 11, and performs a switching operation in accordance with a first switch signal (S1) supplied from the controller 25. The second switch 24 can be connected between the second current source 22 and the detecting pin 11, and performs a switching operation in accordance with a second switch signal (S2) supplied from the controller 25. For example, the first switch 23 is turned on when S1 is at a high level and is turned off when S1 is at a low level.

The buffer 20 can generate a detecting signal (DET) in accordance with states of the detecting pin 11 and the first signal pin 12, and can supply the detecting signal to the controller 25. A detecting pin voltage (J_DET) of the detecting pin 11 can be determined in accordance with a resistance between the detecting pin 11 and the first signal pin 12 and the buffer 20 outputs the detecting signal in accordance with the detecting pin voltage.

In certain examples, the buffer 20 may have a hysteresis characteristic, for example, to prevent a level of the detecting signal from being changed by noise of the detecting pin voltage. The buffer 20 may output a predetermined high level when the detecting pin voltage is larger than a predetermined reference voltage and may output a predetermined low level when the detecting pin voltage is smaller than the predetermined reference voltage.

In typical operation, when the detecting pin 11 and the first signal pin 12 are not connected to each other, there is no connection between the detecting pin 11 and the first signal pin 12. Then, the detecting pin voltage is maintained at a high level by the first detecting current and the buffer 20 receives the high level detecting pin voltage to output a high level detecting signal.

When the detecting pin 11 and the first signal pin 12 are electrically connected to each other, the first detecting current of the first current source 21 or the second detecting current of the second current source 22 flows between the detecting pin 11 and the first signal pin 12, the detecting pin voltage determined in accordance with the resistance between the detecting pin 11 and the first signal pin 12 is input to the buffer 20, and the buffer 20 outputs the detecting signal determined in accordance with the input detecting pin voltage.

When the audio jack 2 is combined with the audio socket 10, the resistance between the detecting pin 11 and the first signal pin 12 is low. Therefore, the detecting pin voltage input to the buffer 20 is at a low level and the buffer 20 outputs a low level detecting signal. In an example, the second detecting current can be larger than the first detecting current. For example, when the first detecting current is 0.5 μA, the second detecting current may be 300 μA.

In a state where the audio jack 2 is combined with the audio socket 10, the detecting pin voltage input to the buffer 20 can be at a low level. For example, the buffer 20 can maintain the low level detecting signal after the second detecting current, instead of or together with the first detecting current, flows between the detecting pin 11 and the first signal pin 12.

However, when foreign particles (e.g., moisture, metal whiskers, dendrite growth, etc.) exist between the detecting pin 11 and the first signal pin 12, and not the audio jack 2, the resistance between the two pins is typically very large in contrast to when the audio jack 2 is coupled to the audio socket 10. In this example, when the second detecting current flows between the detecting pin 11 and the first signal pin 12, the detecting pin voltage is at a high level and the buffer 20 outputs a high level detecting signal in accordance with the high level detecting pin voltage.

The controller 25 detects whether the audio jack 2 is combined with the audio socket 10 using the detecting signal. The second current source 22 instead of the first current source 21 is connected to the detecting pin 11 in synchronization with a combination starting point. The combination starting point is a point in time when the detecting pin 11 was electrically separated from the first signal pin 12 and is then connected to the first signal pin 12. At the combination starting point, either the audio jack 2 or the foreign particles are connected between the detecting pin 11 and the first signal pin 12. The controller 25 determines that the audio jack 2 is combined with the audio socket 10 when a level of the detecting signal is maintained at a level of the combination starting point after the second current source 22 is connected to the detecting pin 11. The controller 25 generates an enable signal (EN) when it is determined that the audio jack 2 is combined with the audio socket 10.

When the detecting signal is at a high level, the controller 25 generates the high level first switch signal for turning on the first switch 23 and the low level second switch signal for turning off the second switch 24. After a predetermined delay from the combination starting point when the detecting signal is reduced to a low level, the controller 25 generates the low level first switch signal for turning off the first switch 23 and the high level second switch signal for turning on the second switch 24. Then, the second detecting current is supplied to the detecting pin 11 instead of the first detecting current. When it is determined that the low level detecting signal is maintained after the second detecting current starts to be supplied, the controller 25 generates the enable signal.

As described above, when the foreign particles exist between the detecting pin 11 and the first signal pin 12, the detecting pin voltage is increased by the second detecting current so that a level the detecting signal is also increased. When the level of the detecting signal is reduced and then increased within a predetermined period, the controller 25 determines that a foreign particle exists between the detecting pin 11 and the first signal pin 12, and not the audio jack 2, and does not generate the enable signal.

The present inventors have recognized, among other things, alternative circuits and methods for detecting foreign particles between pins of an audio socket 10. For example, the circuits described in FIGS. 3-12 can treat foreign particles, such as moisture, as specific detectable impedance ranges, or as an impedance to ground. Examples of moisture can include, but are not limited to, water, liquids, precipitation, perspiration, etc. For example, if moisture is detected in an audio socket 10 of an electronic device (e.g., a mobile device), one or more components or processes in the electronic device can be turned off or altered in response thereto, such as to save power or to avoid damage to one or more components of the electronic device.

Different foreign particles can provide different impedance values. For example, tap water or precipitation can provide a relatively high impedance value, higher than an audio jack connection, but lower than an open circuit. However, moisture with a higher salt content, such as salt water or sweat, has a lower impedance than tap water, but higher than an audio jack connection. Other examples of foreign particles can include dendrite growth, metal whiskers, broken audio socket connections or other errant conductors, etc. In an example, the specific impedance range of the foreign particle can be determined using a plurality of comparators having different reference voltages. In certain examples, the type of foreign particle can be determined using the detected impedance range.

FIGS. 3-12 illustrate generally example audio jack detection systems, including an audio jack 2, an audio processing unit 3, an audio socket 10, and a controller 25. As described above, the audio socket 10 includes a detecting pin 11, a first signal pin 12, a second signal pin 13, a ground pin 14, and a microphone (MIC) pin 15, and the audio jack 2 includes a left audio terminal (A), a right audio terminal (B), a ground terminal (C), and a MIC terminal (D).

In certain examples, the controller 25 can receive an indication that something (e.g., an audio jack 2, moisture or one or more other foreign particles, etc.) has been inserted into the audio socket 10, for example, using the circuits shown and described herein or one or more other circuits not shown. Once that indication has been received, the audio jack detection circuit can determine the content of the audio socket 10 using the circuits and methods described herein.

Figure 3:
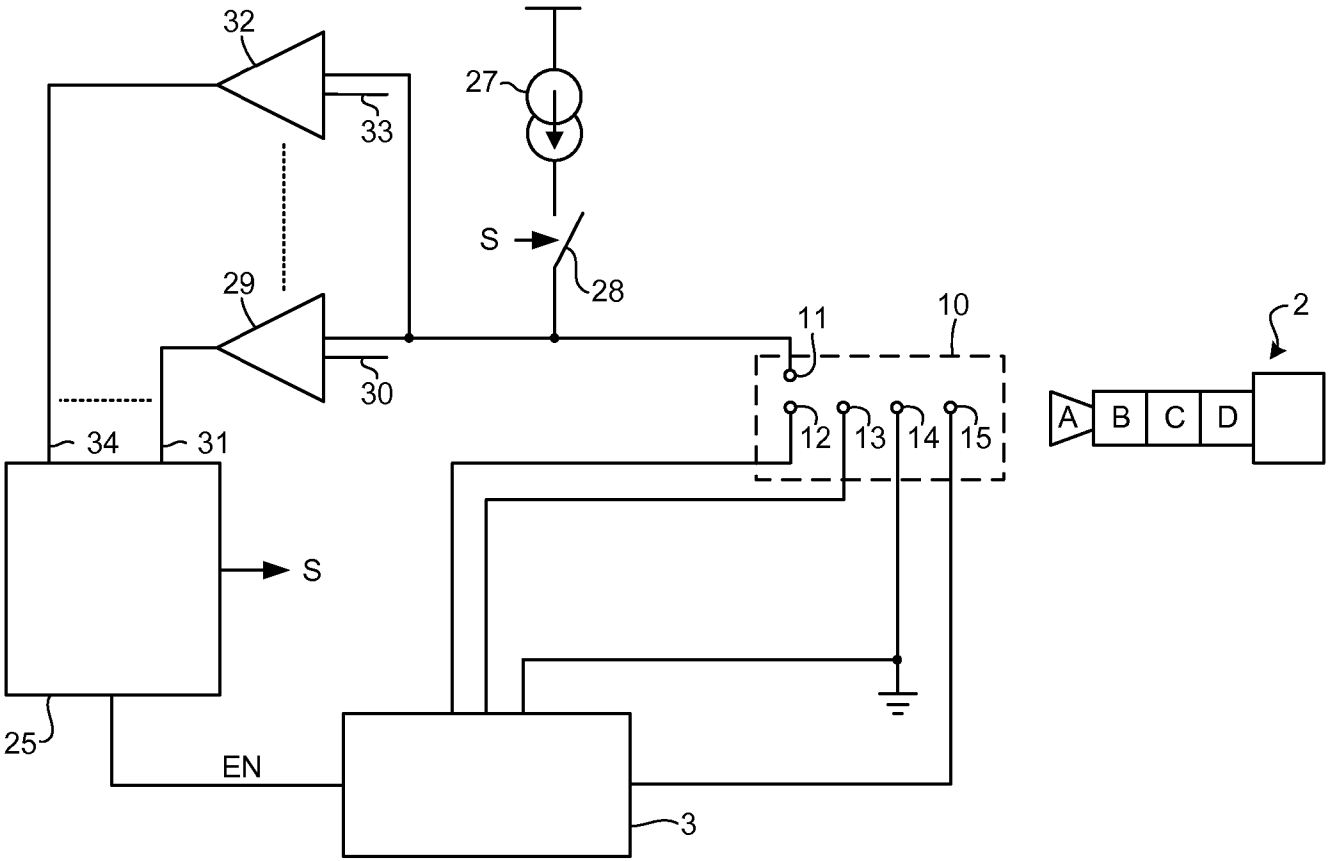

FIG. 3 illustrates generally an audio jack detection circuit including a single current source and multiple comparators. The audio jack detection circuit of FIG. 3 includes a current source 27 configured to generate a detecting current (I). The detecting current can be provided to or isolated from the detecting pin 11 using a switch 28 controlled by a switch signal (S) received from the controller 25. In certain examples, both the switch 28 and the current source 27 can be controlled by the controller 25. In other examples, the switch 28 can be removed and the controller 25 can control the current source 27 directly.

When the connection between the detecting pin 11 and one or more other pins of the audio socket 10 (i.e., in this example, the first signal pin 12) is open, the voltage on the detecting pin 11 will be high. When the audio jack 2 is plugged into the audio socket 10, the impedance between the detecting pin 11 and the first signal pin 12 is low, and the voltage on the detecting pin 11 will be correspondingly low. However, when a foreign particle has entered the audio socket 10, the impedance between the detecting pin 11 and the first signal pin 12 will depend on the type of foreign particle and its orientation in the audio socket 10.

The audio jack detection circuit of FIG. 3 includes first and second comparators 29, 32. In an example, the multiple comparators can consist of only the first and second comparators 29, 32. In other examples, the multiple comparators can include more than the first and second comparators 29, 32. Each of the multiple comparators can receive a reference voltage at a respective reference input (e.g., a first reference input 30 and a second reference input 33) and provide an output (e.g., a first output 31 and a second output 34) depending on a comparison of a detecting pin voltage (J_DET) from the detecting pin 11 and the respective reference input. The controller 25 can determine an impedance between the detecting pin 11 and the first signal pin 12 (or one or more other pins) using the output of the multiple comparators, such as by decoding the outputs of the multiple comparators and associating the outputs with predefined impedance ranges.

Figure 4:
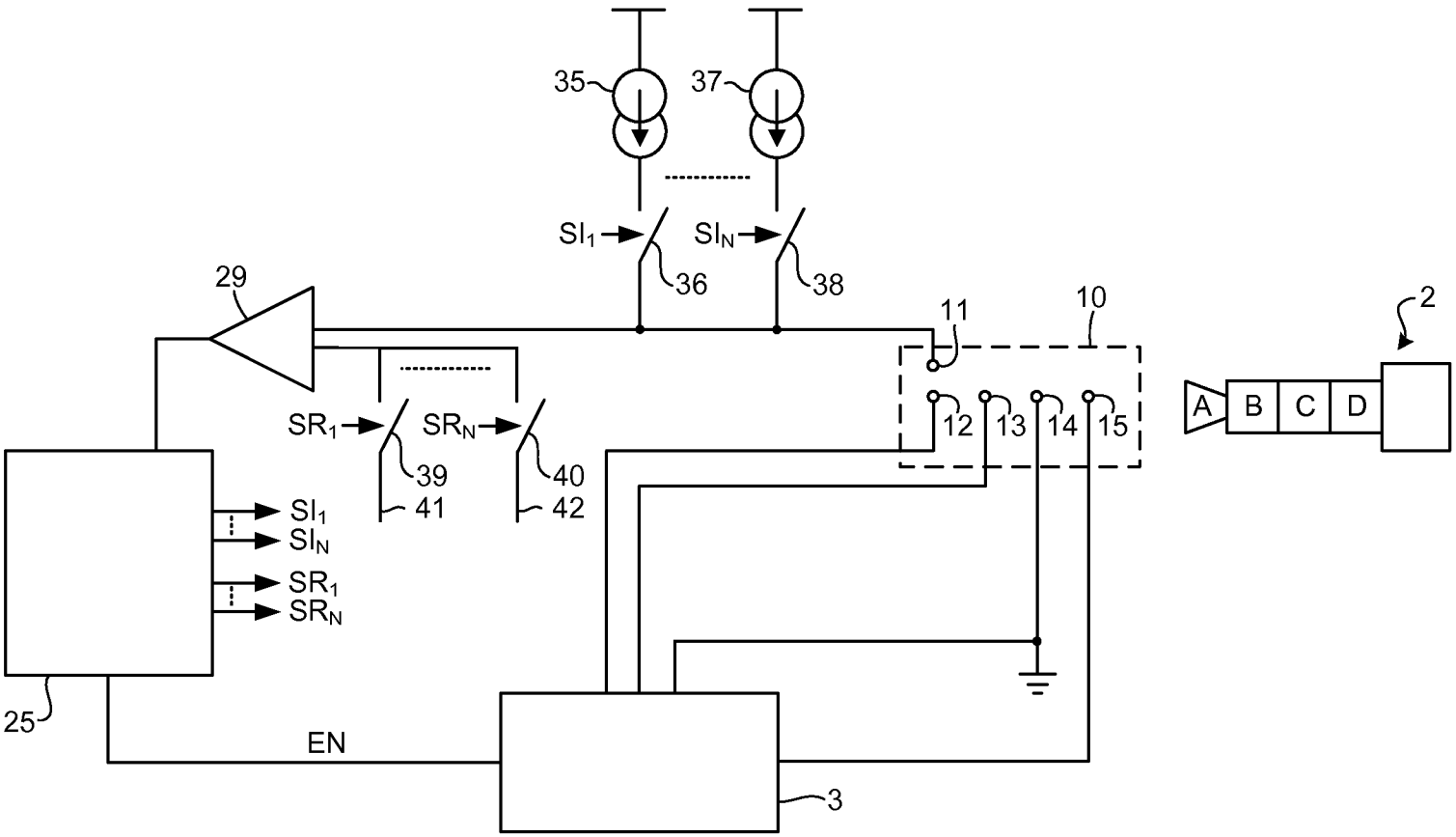

FIG. 4 illustrates generally an audio jack detection circuit including multiple current sources and a single comparator having multiple reference inputs. The audio jack detection circuit of FIG. 4 includes first and second current sources 35, 37 configured to generate first and second detecting currents ($I_1$, $I_N$). In an example, the multiple current sources can consist of only the first and second current sources 35, 37. In other examples, the multiple current sources can include more than the first and second current sources 35, 37. Each of the multiple current sources can be coupled to or isolated from the detecting pin 11 using a respective switch (e.g., first and second switches 36, 38) controlled by a respective switch signal (e.g., first and second switch signals ($SI_1$, $SI_N$) from the controller 25. In various examples, the multiple current sources can have the same or different values, and can be switched on or off at the same or different times, depending on desired current configurations or requirements. In certain examples, the multiple current sources and the respective switches can be controlled by the controller 25. In other examples, the respective switches can be removed and the controller 25 can control the multiple current sources directly.

The audio jack detection circuit of FIG. 4 includes a comparator 29 configured to receive multiple reference inputs (e.g., first and second reference inputs 41, 42) through respective switches (e.g., third and fourth switches 39, 40), compare a detecting pin voltage (J_DET) from the detecting pin 11 to one or more of the multiple reference inputs, and provide an output of the comparison to the controller 25. In an example, the multiple reference inputs can consist of only the first and second reference inputs 41, 42. In other examples, the multiple reference inputs can include more than the first and second reference inputs 41, 42. Each of the multiple reference inputs can be coupled to or isolated from the comparator 29 using the respective switches controlled by respective switch signals (e.g., third and fourth switch signals ($SR_1$, $SR_N$)) from the controller 25. The controller 25 can determine an impedance between the detecting pin 11 and the first signal pin 12 (or one or more other pins) using the output of the comparator 29 and the selected current sources and reference inputs, such as by associating the output of the comaparator 29 and selected current sources and reference inputs with predefined impedance ranges. In an example, the controller 25 can adjust the selected current sources or the reference inputs to determine the impedance.

Figure 5:
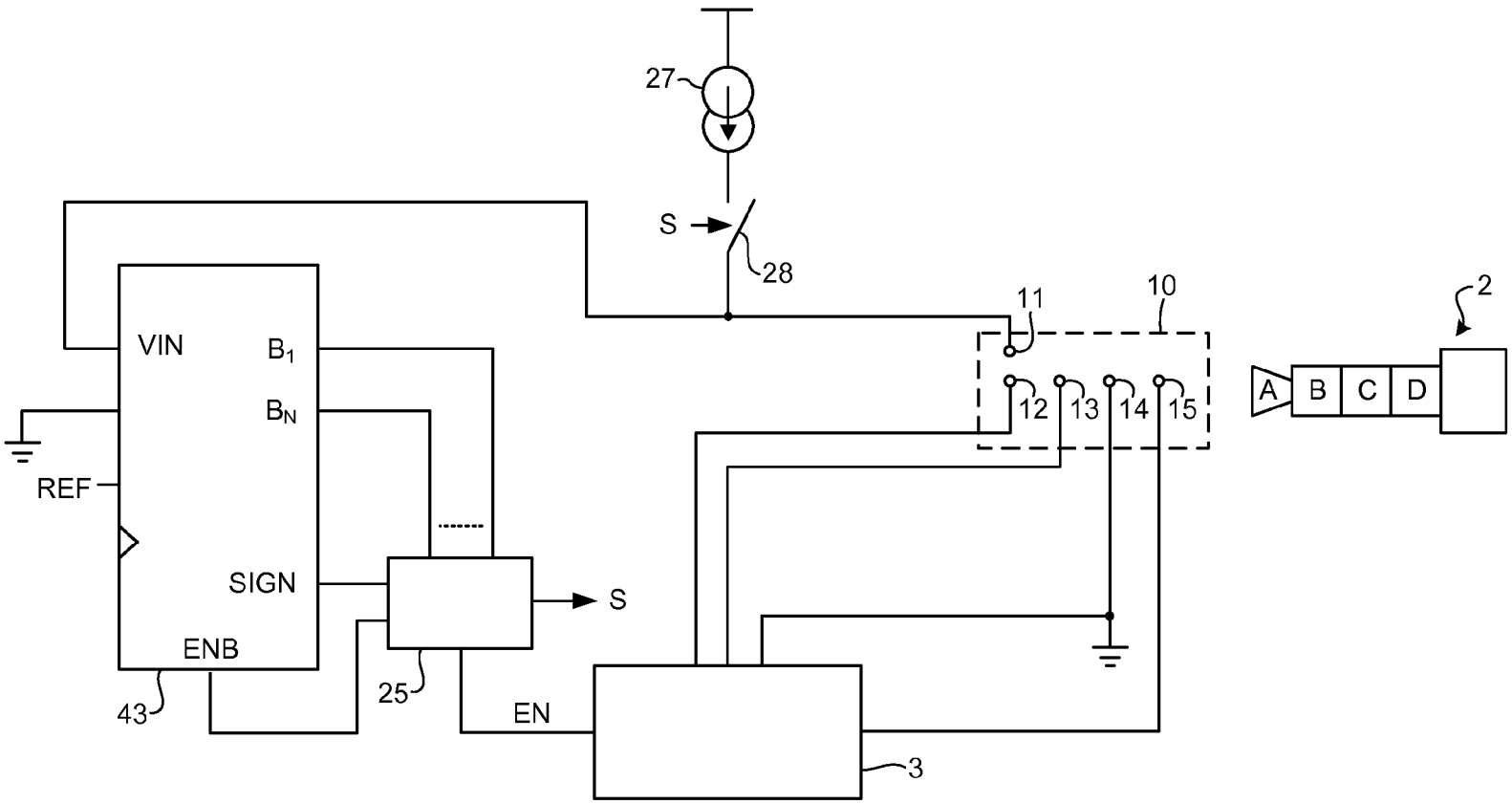

FIG. 5 illustrates generally an audio jack detection circuit including a single current source and an analog-to-digital converter (ADC). The audio jack detection circuit of FIG. 5 includes a current source 27 configured to generate a detecting current (I). The detecting current can be provided to or isolated from the detecting pin 11 using a switch 28 controlled by a switch signal (S) received from the controller 25. In certain examples, both the switch 28 and the current source 27 can be controlled by the controller 25. In other examples, the switch 28 can be removed and the controller 25 can control the current source 27 directly.

An ADC 43 can receive an analog detecting pin voltage (J_DET) from the detecting pin 11 at an input (VIN) and provide a digital representation of the detecting pin voltage to the controller 25 using multiple output pins (e.g., first and second output pins ($B_1$, $B_N$)). The controller 25 can determine an impedance between the detecting pin 11 and the first signal pin 12 (or one or more other pins) using an output of the ADC 43, such as by decoding the output of the ADC 43 and associating the output of the ADC 43 with predefined impedance ranges.

Figure 6:
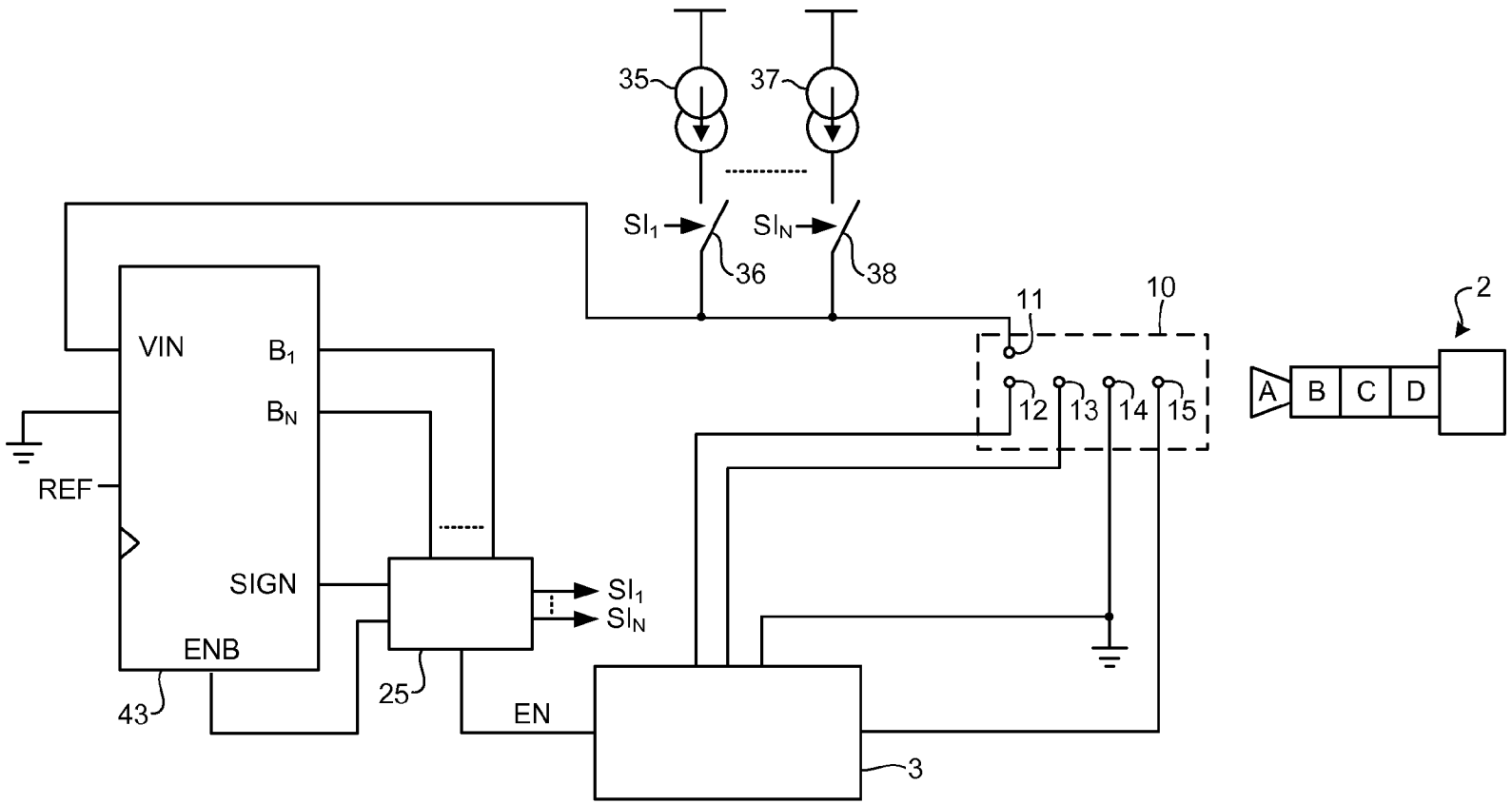

FIG. 6 illustrates generally an audio jack detection circuit including multiple current sources, such as described above with respect to the example of FIG. 4, and an analog-to-digital converter (ADC), such as described above with respect to the example of FIG. 5.

Similarly as described above with respect to the examples of FIGS. 4 and 5, a controller 25 can determine an impedance between a detecting pin 11 and a first signal pin 12 (or one or more other pins) using an output of an ADC 43 and selected current sources, such as by associating the output of the ADC 43 and selected current sources with predefined impedance ranges. In an example, the controller 25 can adjust the selected current sources to determine the impedance.

Figure 7:
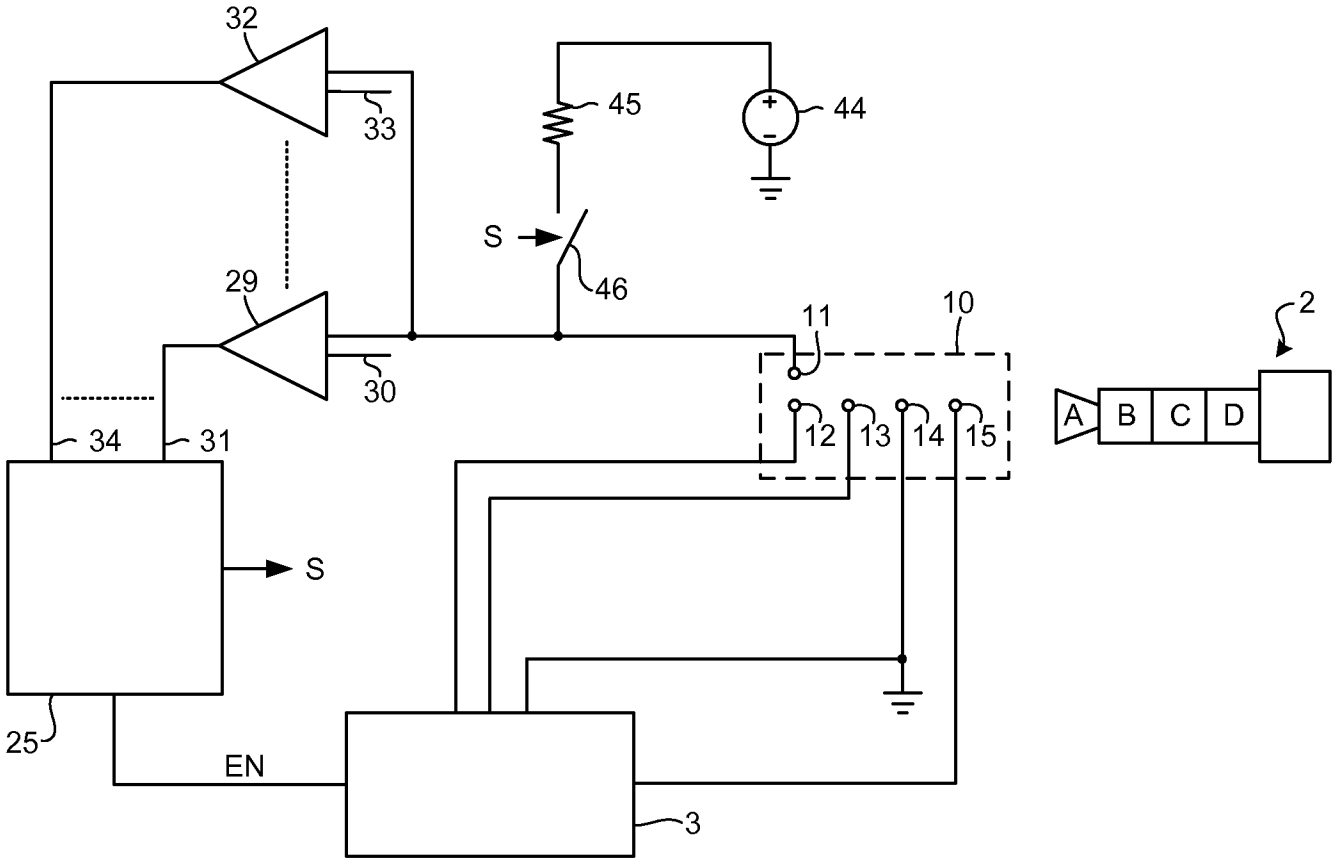

FIG. 7 illustrates generally an audio jack detection circuit including multiple comparators, such as described above with respect to the example of FIG. 3, and a single voltage source and series resistor.

The audio jack detection circuit of FIG. 7 includes a voltage source 44 configured to provide a voltage (V) to a series resistor 45 to generate a detecting current (I). The detecting current can be provided to or isolated from a detecting pin 11 using a switch 46 controlled by a switch signal (S) received from a controller 25. In certain examples, both the switch 46 and the voltage source 44 can be controlled by the controller 25. In other examples, the switch 46 can be removed and the controller 25 can control the voltage source 44 directly.

Similarly as described above with respect to the example of FIG. 3, the controller 25 can determine an impedance between the detecting pin 11 and the first signal pin 12 (or one or more other pins) using the output of the multiple comparators (e.g., first and second comparators 29, 32), such as by decoding the outputs of the multiple comparators and associating the outputs with predefined impedance ranges.

Figure 8:
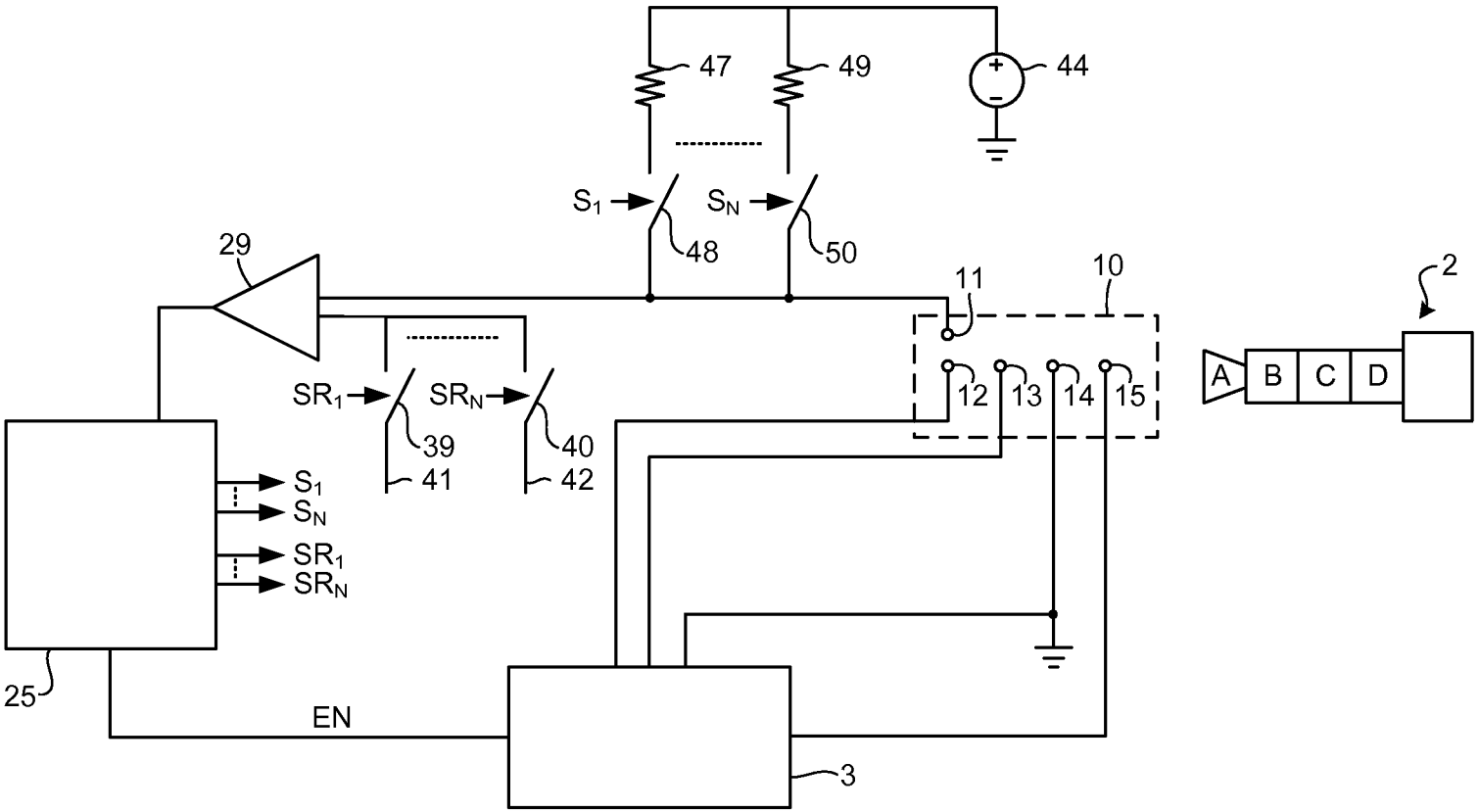

FIG. 8 illustrates generally an audio jack detection circuit including a single comparator having multiple reference inputs, such as described above with respect to the example of FIG. 4, and a single voltage source with multiple series resistors.

The audio jack detection circuit of FIG. 8 includes a voltage source 44 configured to provide a voltage (V) to first and second series resistors 47, 49 to generate first and second detecting currents ($I_1$, $I_N$). In an example, the multiple series resistors can consist of only the first and second series resistors 47, 49. In other examples, the multiple series resistors can include more than the first and second series resistors 47, 49. Each of the multiple series resistors can be coupled to or isolated from the detecting pin 11 using a respective switch (e.g., first and second switches 48, 50) controlled by a respective switch signal (e.g., first and second switch signals ($S_1$, $S_N$) from a controller 25. In various examples, the multiple series resistors can have the same or different values, and can be switched on or off at the same or different times, depending on desired current configurations or requirements.

Similarly as described above with respect to the example of FIG. 4, a controller 25 can determine an impedance between a detecting pin 11 and a first signal pin 12 (or one or more other pins) using the output of a comparator 29 and the selected series resistors and reference inputs, such as by associating the output of the comparator 29 and selected series resistors and reference inputs with predefined impedance ranges. In an example, the controller 25 can adjust the selected series resistors or the reference inputs to determine the impedance.

Figure 9:
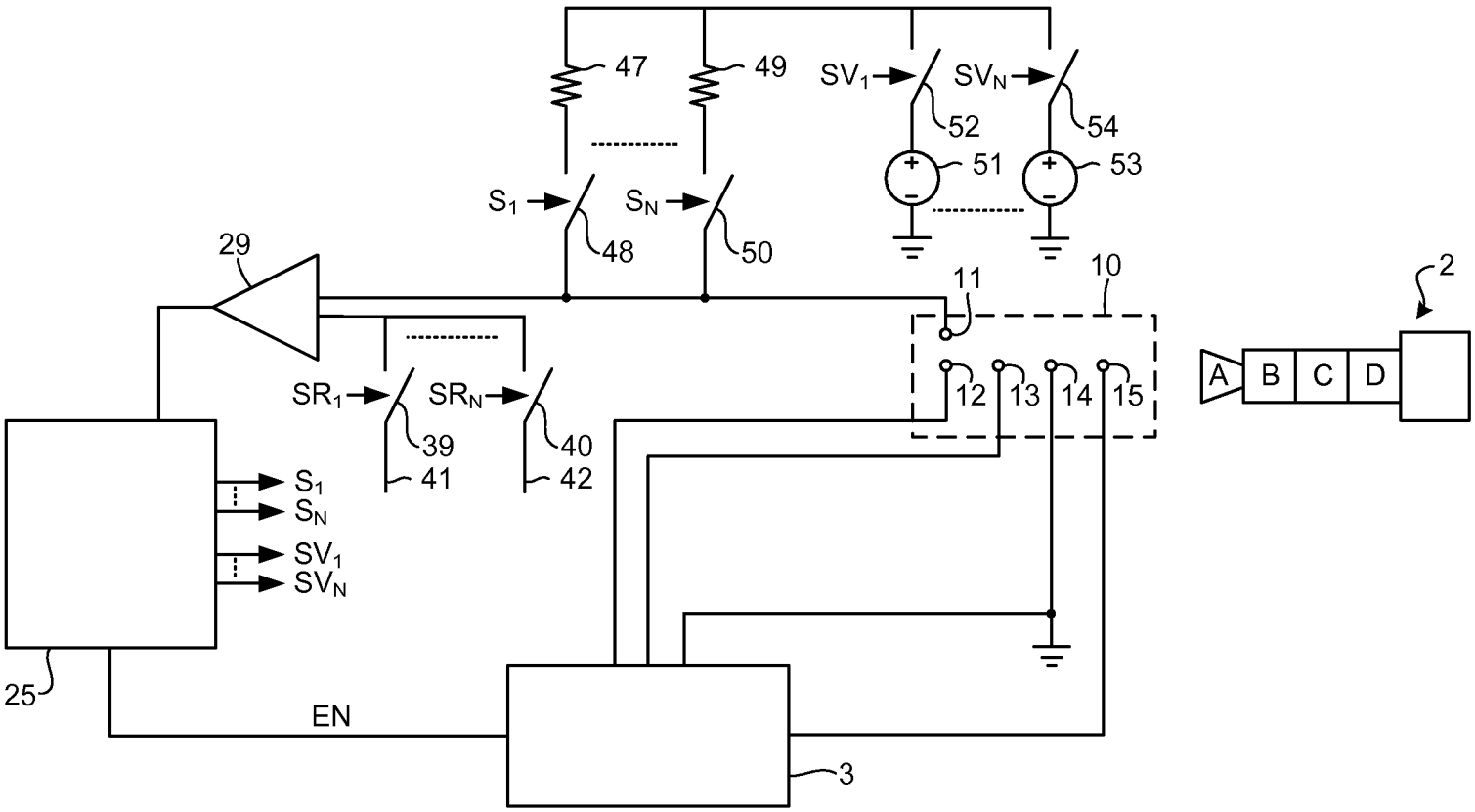

FIG. 9 illustrates generally an audio jack detection circuit including a single comparator having multiple reference inputs, such as described above with respect to the example of FIG. 4, multiple series resistors, such as described above with respect to the example of FIG. 8, and multiple voltage sources.

The audio jack detection circuit of FIG. 9 includes first and second voltage sources 51, 53 configured to provide first and second voltages ($V_1$, $V_N$) to first and second series resistors 47, 49 to generate first and second detecting currents ($I_1$, $I_N$). In an example, the multiple voltage sources can consist of only the first and second voltage sources 51, 53. In other examples, the multiple voltage sources can include more than the first and second voltage sources 51, 53. Each of the multiple voltage sources can be coupled to or isolated from the detecting pin 11 using a respective switch (e.g., fourth and fifth switches 52, 54) controlled by a respective switch signal (e.g., fourth and fifth switch signals ($SV_1$, $SV_N$) from a controller 25. In various examples, the multiple voltage sources can have the same or different values, and can be switched on or off at the same or different times, depending on desired current configurations or requirements.

Similarly as described above with respect to the examples of FIGS. 4 and 8, a controller 25 can determine an impedance between a detecting pin 11 and a first signal pin 12 (or one or more other pins) using the output of a comparator 29 and the selected series resistors, reference inputs, and voltage sources, such as by associating the output of the comparator 29 and selected series resistors, reference inputs, and voltage sources with predefined impedance ranges. In an example, the controller 25 can adjust the selected series resistors, the reference inputs, or the voltage sources to determine the impedance.

Figure 10:
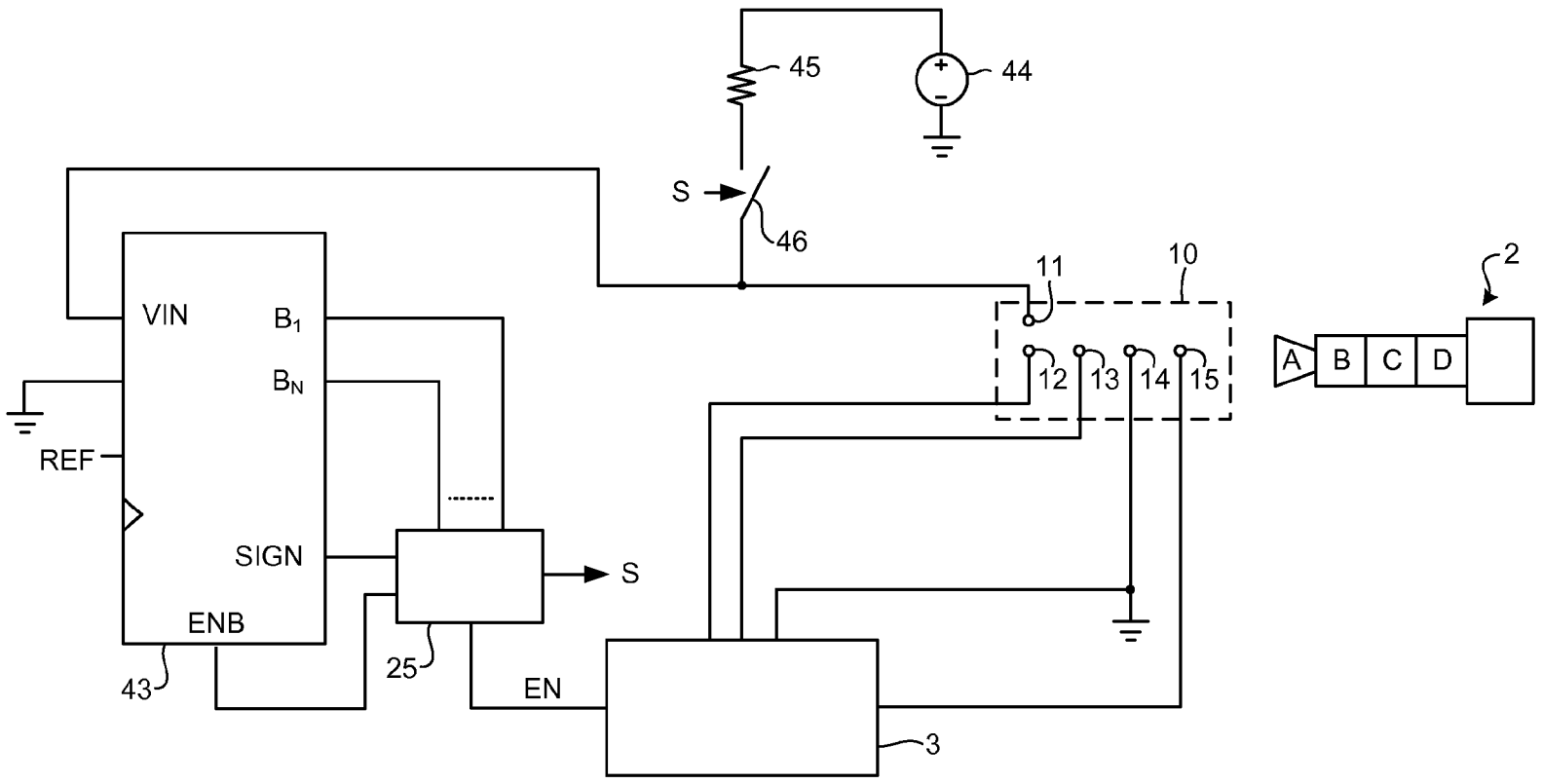

FIG. 10 illustrates generally an audio jack detection circuit including an analog-to-digital converter (ADC), such as described above with respect to the example of FIG. 5, and a single voltage source and series resistor, such as described above with respect to the example of FIG. 7.

Similarly as described above with respect to the examples of FIGS. 5 and 7, a controller 25 can determine an impedance between a detecting pin 11 and a first signal pin 12 (or one or more other pins) using an output of the ADC 43, such as by decoding the output of the ADC 43 and associating the output of the ADC 43 with predefined impedance ranges.

Figure 11:
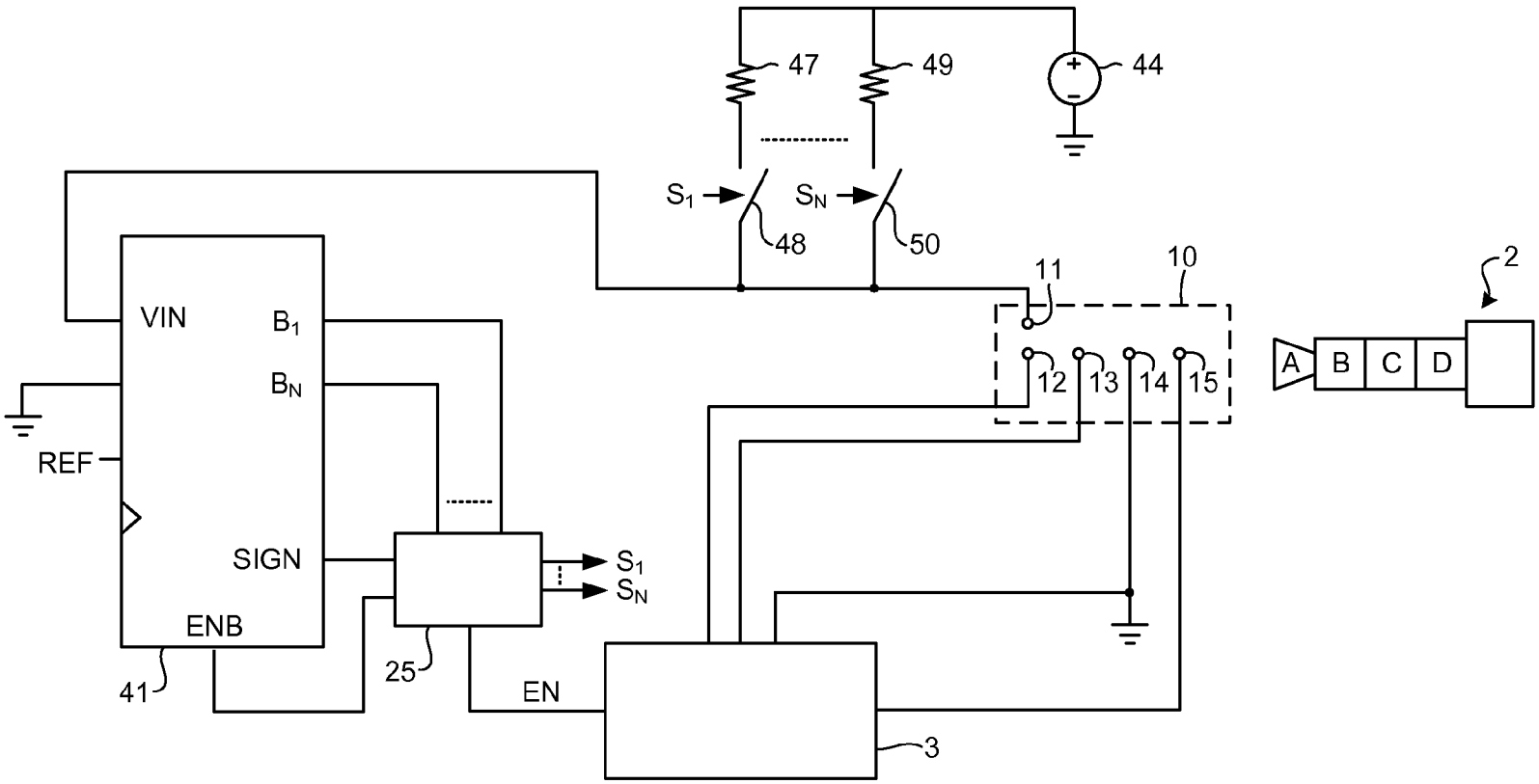

FIG. 11 illustrates generally an audio jack detection circuit including an analog-to-digital converter (ADC), such as described above with respect to the example of FIG. 5, and a single voltage source with multiple series resistors, such as described above with respect to the example of FIG. 8.

Similarly as described above with respect to the examples of FIGS. 5 and 8, a controller 25 can determine an impedance between a detecting pin 11 and a first signal pin 12 (or one or more other pins) using an output of an ADC 43 and selected series resistors, such as by associating the output of the ADC 43 and selected series resistors with predefined impedance ranges. In an example, the controller 25 can adjust the selected series resistors to determine the impedance.

Figure 12:
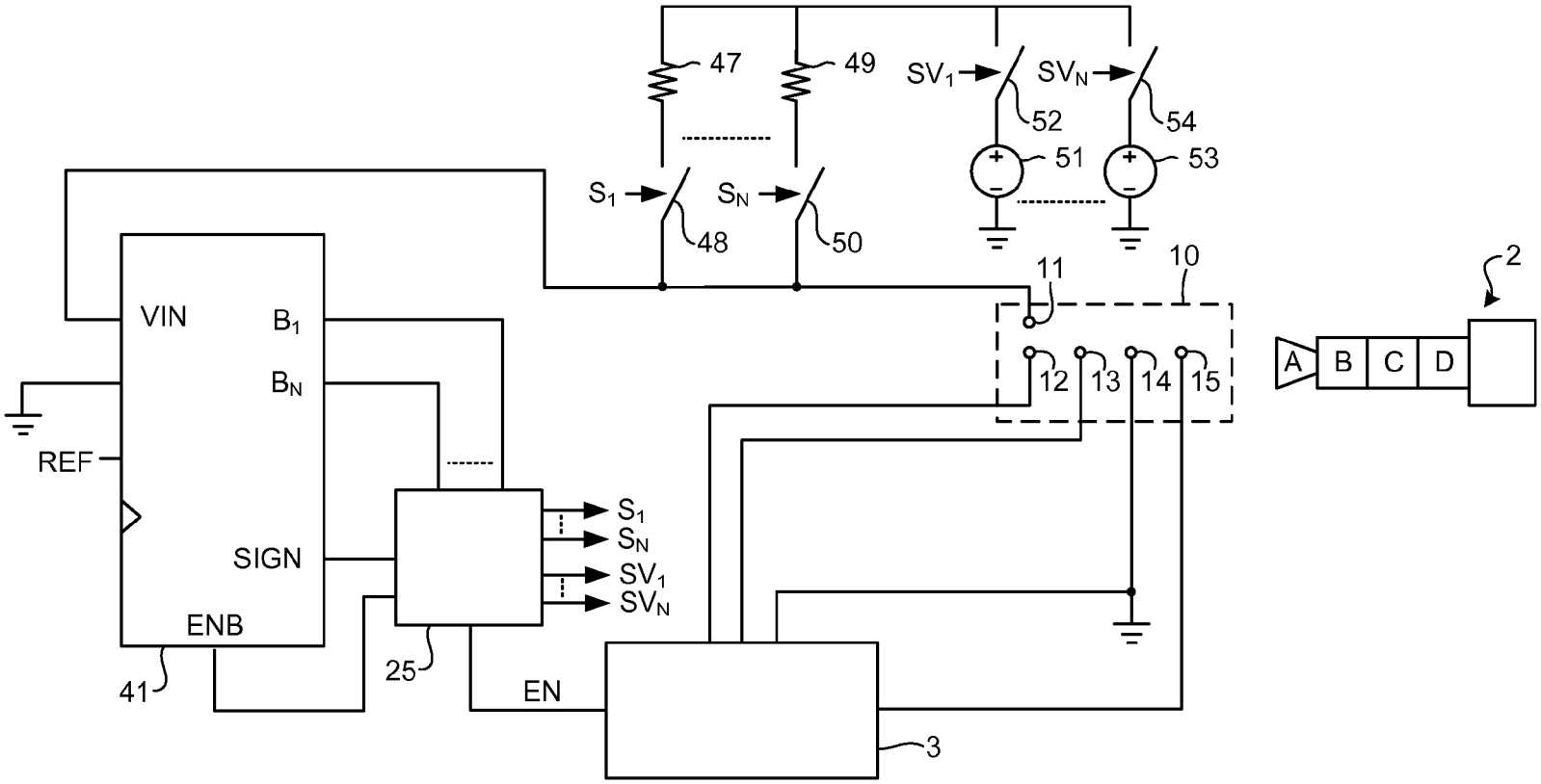

FIG. 12 illustrates generally an audio jack detection circuit including an analog-to-digital converter (ADC), such as described above with respect to the example of FIG. 5, and multiple voltage sources and multiple series resistors, such as described above with respect to the example of FIG. 9

Similarly as described above with respect to the examples of FIGS. 5 and 9, a controller 25 can determine an impedance between a detecting pin 11 and a first signal pin 12 (or one or more other pins) using an output of an ADC 43 and selected series resistors and voltage sources, such as by associating the output of the ADC 43 and selected series resistors and voltage sources with predefined impedance ranges. In an example, the controller 25 can adjust the selected series resistors or the voltage sources to determine the impedance.

In other examples, any one or more of the circuits above can be used to determine a difference in impedance in LEFT and RIGHT speakers, if a device connected to the audio jack, or the audio jack itself, is stereo capable.

In an example, any one or more of the detection circuits described above can be applied to a single receptacle pin (terminal), multiple receptacle pins (terminals), or different types of receptacles (jacks), each according to various standards. In an example, the single receptacle pin or any one or more of the multiple receptacle pins may or may not be connected to system ground. Further, the current sources described in the circuits above can be replaced by one or more current sinks.

ADDITIONAL NOTES AND EXAMPLES

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, the code can be tangibly stored on one or more volatile or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An audio jack detection circuit, comprising:

a switch configured to provide a detecting current to or to isolate a detecting current from a detecting pin of an audio socket;

a first comparator configured to compare a voltage from the detecting pin to a first reference voltage and to provide a first output; and a second comparator configured to compare the voltage from the detecting pin to a second reference voltage and to provide a second output, wherein the first and second outputs provide an indication of an impedance between the detecting pin and a first signal pin of the audio socket in one of three predetermined impedance ranges, the three impedance ranges including:

a first impedance range corresponding to an open circuit between the detecting pin and the first signal pin;

a second impedance range corresponding to moisture between the detecting pin and the first signal pin; and a third impedance range corresponding to an audio jack connection between the detecting pin and the first signal pin.

2. The audio jack detection circuit of claim 1, including:

a controller configured to provide a switch signal to control the state of the switch, wherein the controller is configured to provide the indication of the impedance between the detecting pin and a first signal pin of the audio socket using the first and second outputs.

3. The audio jack detection circuit of claim 2, wherein the controller is configured to provide a signal to disable communication between an audio processing unit and the audio socket if the indication of impedance indicates that moisture is present in the audio socket.

4. The audio jack detection circuit of claim 2, wherein the controller is configured to provide a signal to disable communication between an audio processing unit and the audio socket if the indication of impedance indicates that moisture is present between the detecting pin and the first signal pin of the audio socket.

5. The audio jack detection circuit of claim 2, wherein the controller is configured to determine an impedance range of the impedance between the detecting pin and the first signal pin of the audio socket using the first and second outputs.

6. The audio jack detection circuit of claim 5, wherein the impedance range corresponds to one of:

an open circuit;

moisture; or an audio jack connection.

7. The audio jack detection circuit of claim 1, including a current source configured to generate the detecting current.

8. An audio jack detection system, comprising:

a current source configured to generate a detecting current;

a switch configured to provide the detecting current to or to isolate the detecting current from a detecting pin of an audio socket;

a controller configured to provide a switch signal to control the state of the switch;

a first comparator configured to compare a voltage from the detecting pin to a first reference voltage and to provide a first output to the controller; and a second comparator configured to compare the voltage from the detecting pin to a second reference voltage and to provide a second output to the controller, wherein the controller is configured to provide an indication of an impedance between the detecting pin and a first signal pin of the audio socket in one of three predetermined impedance ranges using the first and second outputs, the three impedance ranges including:

a first impedance range corresponding to an open circuit between the detecting pin and the first signal pin;

a second impedance range corresponding to moisture between the detecting pin and the first signal pin; and a third impedance range corresponding to an audio jack connection between the detecting pin and the first signal pin.

9. The audio jack detection system of claim 8, wherein the controller is configured to determine an impedance range of the impedance between the detecting pin and the first signal pin of the audio socket using the first and second outputs.

10. The audio jack detection system of claim 9, wherein the impedance range corresponds to one of:

an open circuit;

moisture; or an audio jack connection.

11. The audio jack detection system of claim 8, including:

the audio socket, including the detecting pin, the first signal pin, a second signal pin, a ground pin, and a microphone pin; and an audio processing unit configured to provide a first audio signal to the first signal pin, a second audio signal to the second signal pin, a ground signal to the ground pin, and to receive a microphone signal from the microphone pin.

12. The audio jack detection system of claim 11, wherein the first signal pin is a left speaker pin and the second signal pin is a right signal pin.

13. The audio jack detection system of claim 11, wherein the first signal pin is a right speaker pin and the second signal pin is a left signal pin.

14. The audio jack detection system of claim 8, wherein the controller is configured to provide a signal to disable communication between the audio processing unit and the audio socket if the indication of impedance indicates that moisture is present in the audio socket.

15. The audio jack detection system of claim 8, wherein the controller is configured to provide a signal to disable communication between the audio processing unit and the audio socket if the indication of impedance indicates that moisture is present between the detecting pin and the first signal pin of the audio socket.

16. An audio jack detection method, comprising:

selectively providing a detecting current to a detecting pin of an audio socket using a switch;

comparing a voltage from the detecting pin to a first reference voltage using a first comparator and providing a first output indicative of the comparison;

comparing the voltage from the detecting pin to a second reference voltage using a second comparator and providing a second output indicative of the comparison; and providing an indication of an impedance between the detecting pin and a first signal pin of the audio socket in one of three predetermined impedance ranges using the first and second outputs, the three impedance ranges including:

a first impedance range corresponding to an open circuit between the detecting pin and the first signal pin;

a second impedance range corresponding to moisture between the detecting pin and the first signal pin; and a third impedance range corresponding to an audio jack connection between the detecting pin and the first signal pin.

17. The audio jack detection method of claim 16, including:

providing a signal to disable communication between an audio processing unit and the audio socket using a controller if the indication of impedance indicates that moisture is present in the audio socket.

18. The audio jack detection method of claim 17, including:

providing a signal to disable communication between an audio processing unit and the audio socket using a controller if the indication of impedance indicates that moisture is present between the detecting pin and the first signal pin of the audio socket.

19. The audio jack detection method of claim 16, including:

determining an impedance range of the impedance between the detecting pin and the first signal pin of the audio socket using the first and second outputs.

20. The audio jack detection method of claim 19, wherein the impedance range corresponds to one of:

an open circuit;

moisture; or an audio jack connection.

* * * * *